US008397635B2

(12) United States Patent
Feygelman et al.

(10) Patent No.: US 8,397,635 B2
(45) **Date of Patent: *Mar. 19, 2013**

(54) IMAGE TRANSFER MECHANISM

(75) Inventors: Alex Feygelman, Petrach Tigwa (IL); Ofer Fredi, Gadera (IL)

(73) Assignee: Hewlett-Packard Indigo B.V. (NL)

( * ) Notice: Subject to any disclaimer, the term of this patent is extended or adjusted under 35 U.S.C. 154(b) by 277 days.

This patent is subject to a terminal disclaimer.

(21) Appl. No.: 12/582,331

(22) Filed: Oct. 20, 2009

(65) Prior Publication Data

US 2010/0031837 A1 Feb. 11, 2010

Related U.S. Application Data

(63) Continuation of application No. 11/190,378, filed on Jul. 26, 2005, now Pat. No. 7,628,109, which is a continuation of application No. PCT/IL03/00083, filed on Feb. 2, 2003.

(51) Int. Cl.
*B41F 21/00* (2006.01)
*B41F 21/10* (2006.01)
*G03G 15/14* (2006.01)

(52) U.S. Cl. ..... 101/409; 101/246

(58) Field of Classification Search ..... 101/408, 101/409, 246; 399/399; 271/82, 277
See application file for complete search history.

(56) References Cited

U.S. PATENT DOCUMENTS

| | | | |
|---|---|---|---|
| 4,796,529 | A | 1/1989 | Mathes |
| 4,875,069 | A | 10/1989 | Takada et al. |
| 5,026,045 | A | 6/1991 | Wirz et al. |
| 5,503,075 | A | 4/1996 | Matsuo et al. |
| 5,562,036 | A | 10/1996 | Barrois et al. |
| 5,927,198 | A | 7/1999 | Tada |
| 5,960,719 | A | 10/1999 | Sunderman et al. |
| 6,244,178 | B1 | 6/2001 | DeMoore et al. |
| 6,912,952 | B1 | 7/2005 | Landa et al. |
| 7,048,011 | B2 | 5/2006 | DeMoore et al. |
| 7,082,873 | B2 | 8/2006 | De Moore et al. |
| 7,107,904 | B2 | 9/2006 | Kusaka |
| 2002/0043169 | A1 | 4/2002 | Hawkes |
| 2006/0249041 | A1 | 11/2006 | DeMoore et al. |
| 2007/0022889 | A1 | 2/2007 | Feygelman et al. |

FOREIGN PATENT DOCUMENTS

| | | |
|---|---|---|
| JP | 64-27239 | 8/1987 |
| JP | 11-310345 | 11/1999 |
| WO | WO 2004067285 | 8/2004 |

*Primary Examiner* — Judy Nguyen
*Assistant Examiner* — Leo T Hinze

(57) ABSTRACT

A mechanism includes an impression member having an impression surface and impression media covering a portion of the impression surface. In one embodiment, the impression media includes one or more apertures. In one embodiment, the impression media is held by an impression media holding mechanism.

19 Claims, 13 Drawing Sheets

IMAGE TRANSFER MECHANISM

CROSS-REFERENCE TO RELATED PATENT APPLICATIONS

The present application is a continuation application claiming priority from co-pending U.S. patent application Ser. No. 11/190,378 filed on Jul. 26, 2005 by Alex Feygelman and Ofer Fredi and entitled IMAGE TRANSFER MECHANISM, which is a continuation application claiming priority to application PCT/IL03/00083, filed on Feb. 2, 2003, now International Publication WO 2004/067277 A1, titled IMAGE TRANSFER MECHANISM, the full disclosures of which is hereby incorporated by reference.

BACKGROUND OF THE INVENTION

Some existing liquid toner systems utilize an intermediate transfer member to transfer a liquid toner image from a photosensitive member on which the image is developed to a final substrate. In order to reduce problems that may be caused when printing media is misfed, an impression media (generally of paper) is placed between the printing media and an impression roller which holds the printing media during transfer of the liquid toner image thereto from the intermediate transfer member.

The present application is directed to novel impression media and mechanisms utilizing it.

DETAILED DESCRIPTION OF EXEMPLARY EMBODIMENTS

Figure 1:
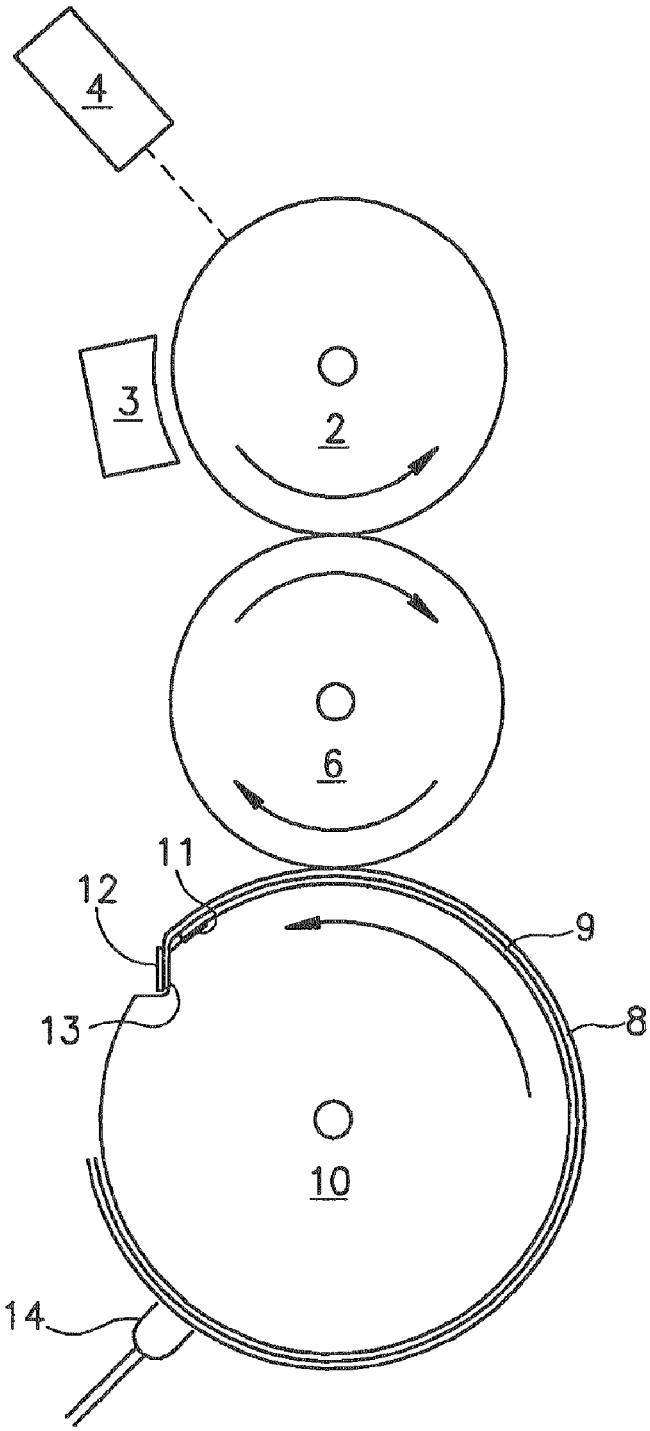
FIG.1 PRIOR ART
FIG. 1 is a schematic cross-sectional view of the photosensitive, intermediate, and impression members as they are arranged in a printer or copier, according to the prior art.

An exemplary configuration of existing laser printers is illustrated in a very simplified form in FIG. 1. A charged photosensitive member 2 is exposed to a light image from a scanning laser 4 controlled by a computer. A similar configuration is used in some copiers, with the scanning laser replaced by a lens focused on a document that is being copied. The areas of the photo-sensitive surface that are exposed to light acquire a different voltage than the parts that are not exposed to light, due to selective discharge of those areas. This voltage difference is used to selectively attract toner particles to parts of the surface, using a developer 3, producing a toner image that corresponds to the exposure. The toner image is then transferred to an intermediate transfer member 6, and from there to a printing medium 8 on an impression member 10 in the exemplary form of a roller. Although the image could be transferred directly from the photo-sensitive member to the impression member, in some systems better results are achieved by using an intermediate transfer member, which can be heated, resulting in better transfer of the toner (especially liquid toner) to the printing media. Of course, this drawing is very simplified.

Figure 2:
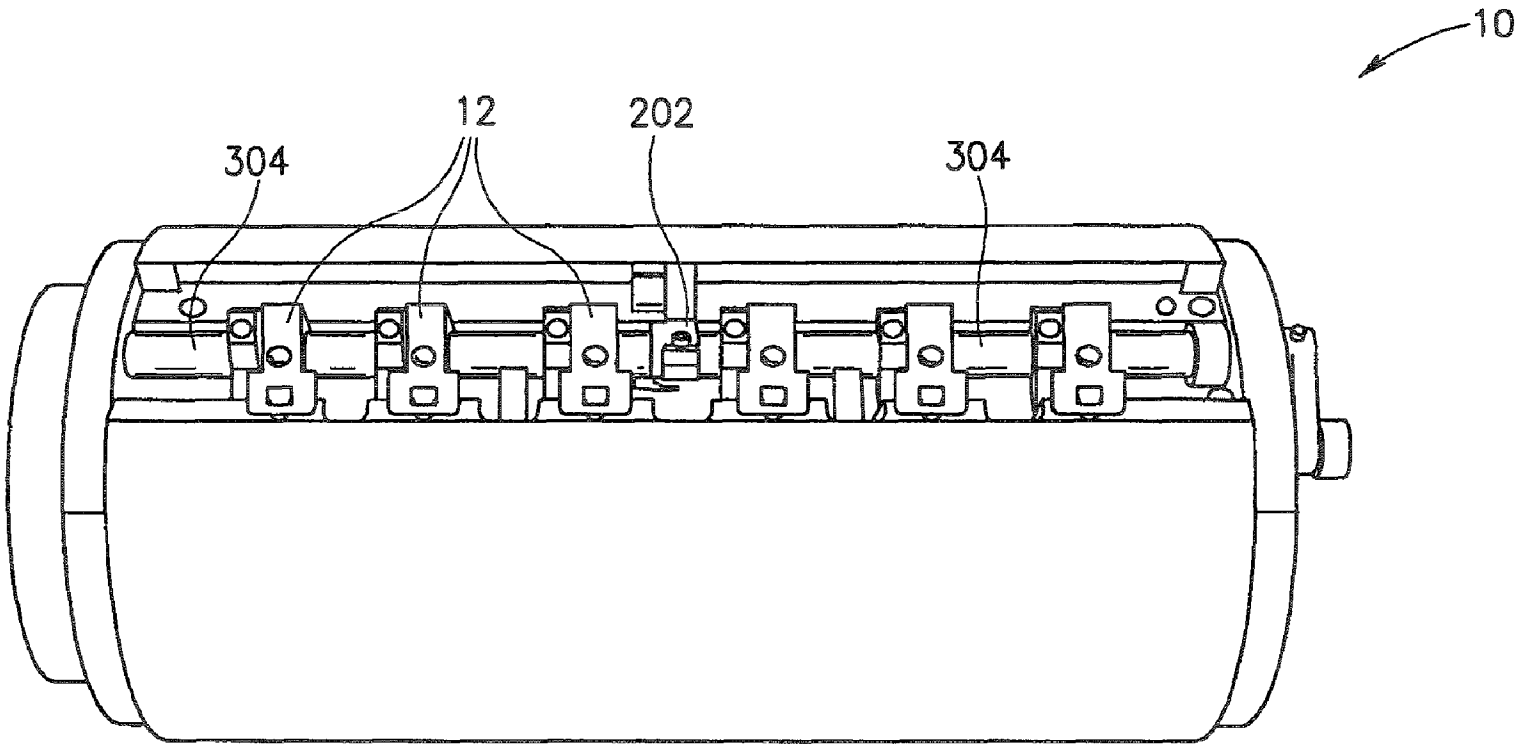
FIG.2 PRIOR ART
FIG. 2 is a perspective view of an impression member, according to the prior art.
Figure 3A:
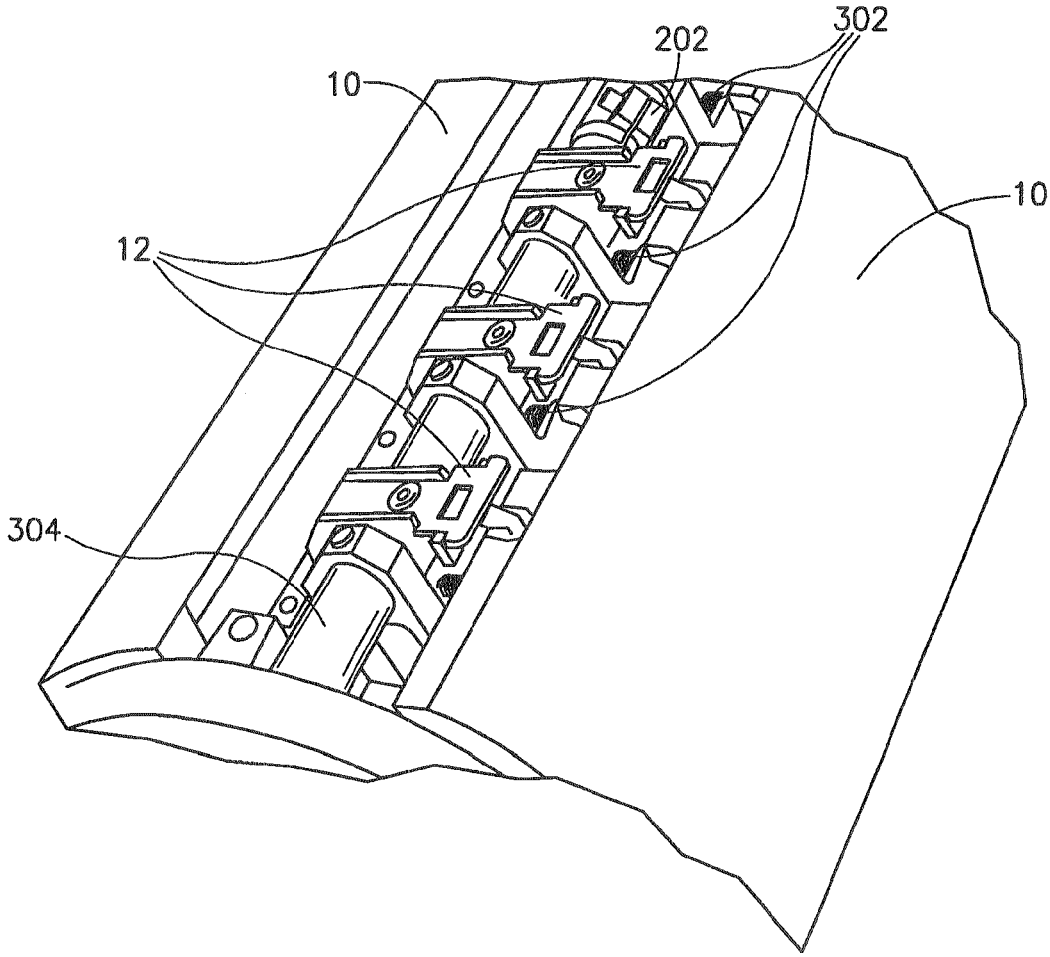
FIG.3A PRIOR ART
FIG. 3A is a close-up perspective view of part of an impression member, according to the prior art, showing printing paper clamps in a raised position.
Figure 3B:
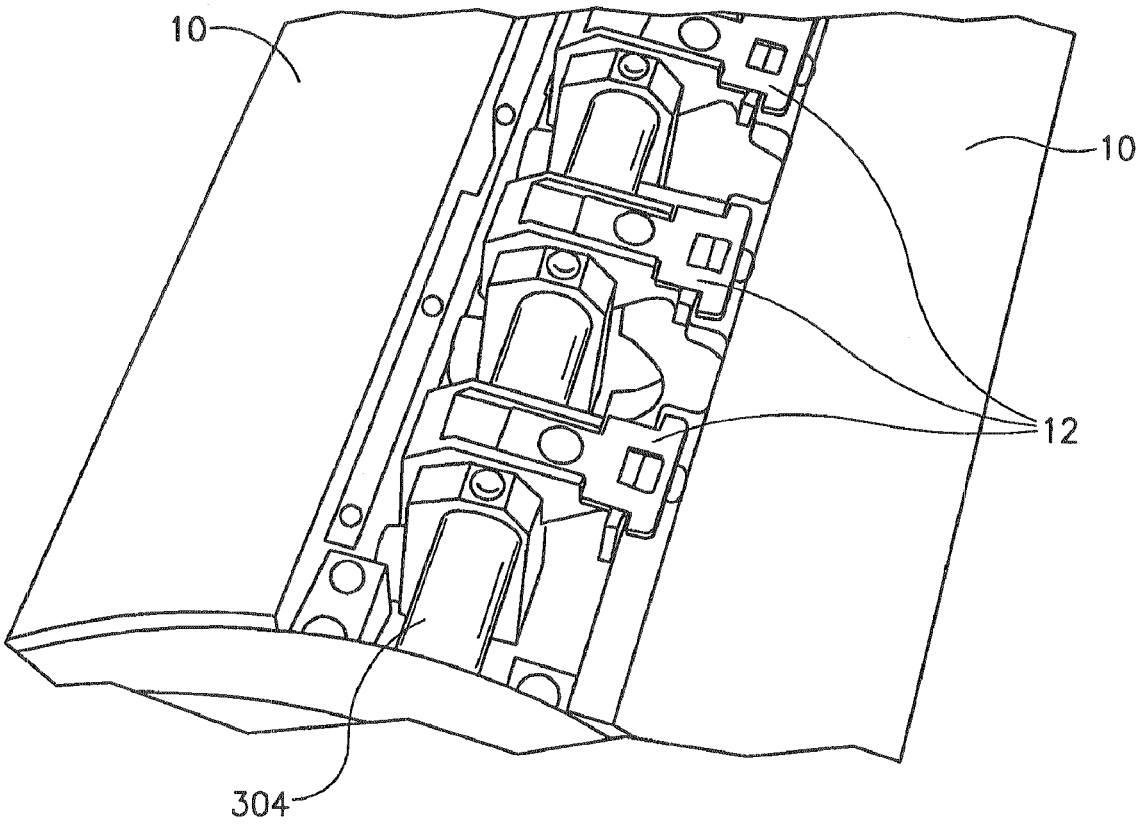
FIG.3B PRIOR ART
FIG. 3B is a similar view to FIG. 3A, but with the printing paper clamps in a lowered position.

The printing media is held to the impression member by printing media grippers 12. FIG. 2 shows the impression member (removed from the printer), seen from one side, and FIGS. 3A and 3B are close-up views of the impression member showing the grippers more clearly. During operation, the opening along the side of the impression member normally has a cover over it, with small openings for the grippers. This cover has been removed in FIGS. 2, 3A, and 3B, to show a rod 304 (or rods, optionally connected by a coupler 202) which controls the raising and lowering of the grippers. In FIG. 3A, grippers 12 are in a raised position, while in FIG. 3B grippers 12 are in a lowered position for holding the printing media. Grippers 12 are optionally spring-loaded, and springs 302 are visible in FIG. 3A. Once the media has been printed, grippers 12 are raised, and the printing media is removed from the impression member by a lifting mechanism, for example including suction elements such as suction cups 14 (shown in FIG. 1), and conveyed to an output tray. Suction elements 14 may be active, i.e., they are connected to a vacuum source, or they are passive, i.e., a vacuum is formed when they are pressed against printing media 8. Generally, active suction elements are preferred.

If there is a paper jam, or some other malfunction, and the grippers do not pick up the printing media, then toner will be transferred from the intermediate transfer member directly to the surface of the impression member. Because the impression member, which has a metal surface, does not absorb toner as well as the printing media, some toner will remain on the intermediate transfer member. If the intermediate transfer member is not immediately cleaned off, then the toner may dry if it is liquid, or possibly melt if it is solid, which may cause permanent damage to the intermediate transfer member. To prevent this from happening, a piece of media, described herein as impression media or impression paper (since it is generally of paper) 9, is sometimes permanently glued to the surface of the impression member at a point designated as 11. The forward edge of the impression media is positioned underneath the printing media, i.e., the forward edge does not extend past the edge 13 of the printing media that is held by the grippers.

Even if the impression member picks up no printing media, the impression paper surface will absorb all the toner from the intermediate transfer member, and the intermediate transfer member will not be damaged by dried toner.

However, the impression paper can create its own problems. First there are the problems connected with gluing. Inter alia, since there may be a slight difference in velocity between the impression roller and the intermediate transfer member (in order to avoid buckling of the paper), there is significant stress on the glue. Therefore, the glue has to be strong. Unfortunately, since paper misfeeds do occur, the impression paper must be removable. This mandates a weaker bond for the glue. Furthermore, the area available for gluing is limited, in order not to interfere with the printable area of the print media and may sometimes intrude on this area slightly. Additionally with time, the impression paper may slide along the impression roller in a direction opposite the direction of motion of the impression roller surface.

The differences of height caused by the presence of glue under the impression paper cause poor or sometimes even an absence of transfer from the intermediate transfer member to the print media. If the impression media needs to be replaced, for example because it is worn or torn or because it has been printed on due to a paper misfeed, it can be difficult to remove the old impression paper completely. Finally, the smooth surface of the impression paper creates a partial vacuum between the impression paper and the printing media, when the latter is picked up by suction elements to remove it from the impression member. This may cause the printing media to be picked up in an uncontrolled manner, especially if it is thin paper.

Figure 4:
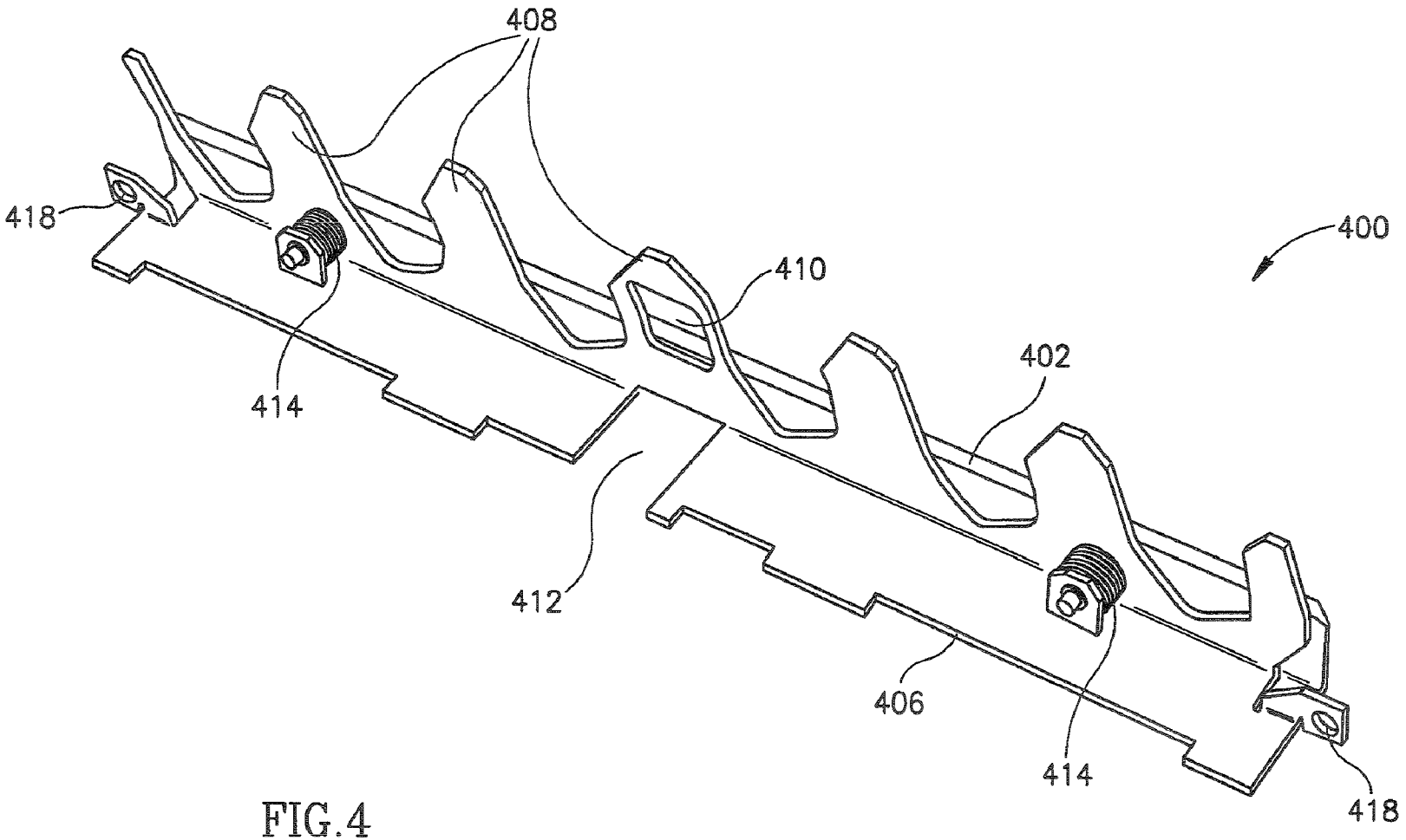
FIG. 4 is a perspective view of an impression paper clamp, seen from below, according to an exemplary embodiment of the invention.

FIG. 4 shows an impression paper clamp 400, as seen from below, according to an exemplary embodiment of the invention. Here, "above" means in a direction away from the impression member when the impression paper clamp is installed, and "below" means toward the interior of the impression member when the impression paper clamp is installed. In describing the impression paper clamp, we use terms such as "above", "below", "upper", "lower", "raised", "lowered", "top" and "bottom" to refer to directions relative to the center of the impression member when the impression paper clamp is installed, even though these terms are only literally true when the impression member is oriented so that the impression paper clamp is uppermost.

Many of the features of the impression paper clamp shown in FIG. 4 are designed to allow the impression paper clamp to be retrofitted to an existing impression member used in printers manufactured by Hewlett-Packard. Some of these features optionally look quite different, or are absent entirely, in embodiments of the invention designed for use on different impression members, without departing from the teachings of the invention.

Figure 6:
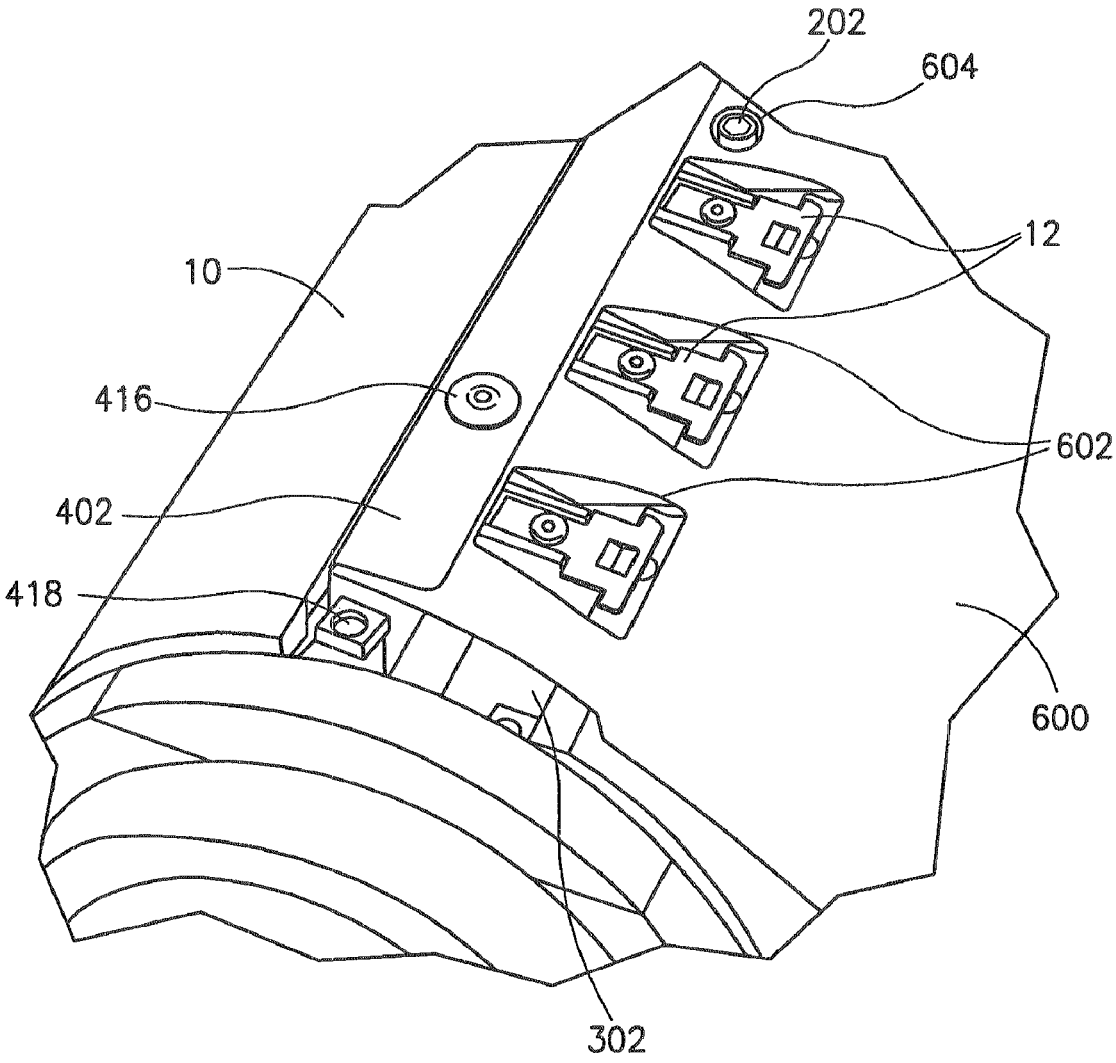
FIG. 6 is the same view as FIG. 5A, but also showing one end of the impression paper held by the impression paper clamp.
Figure 7:
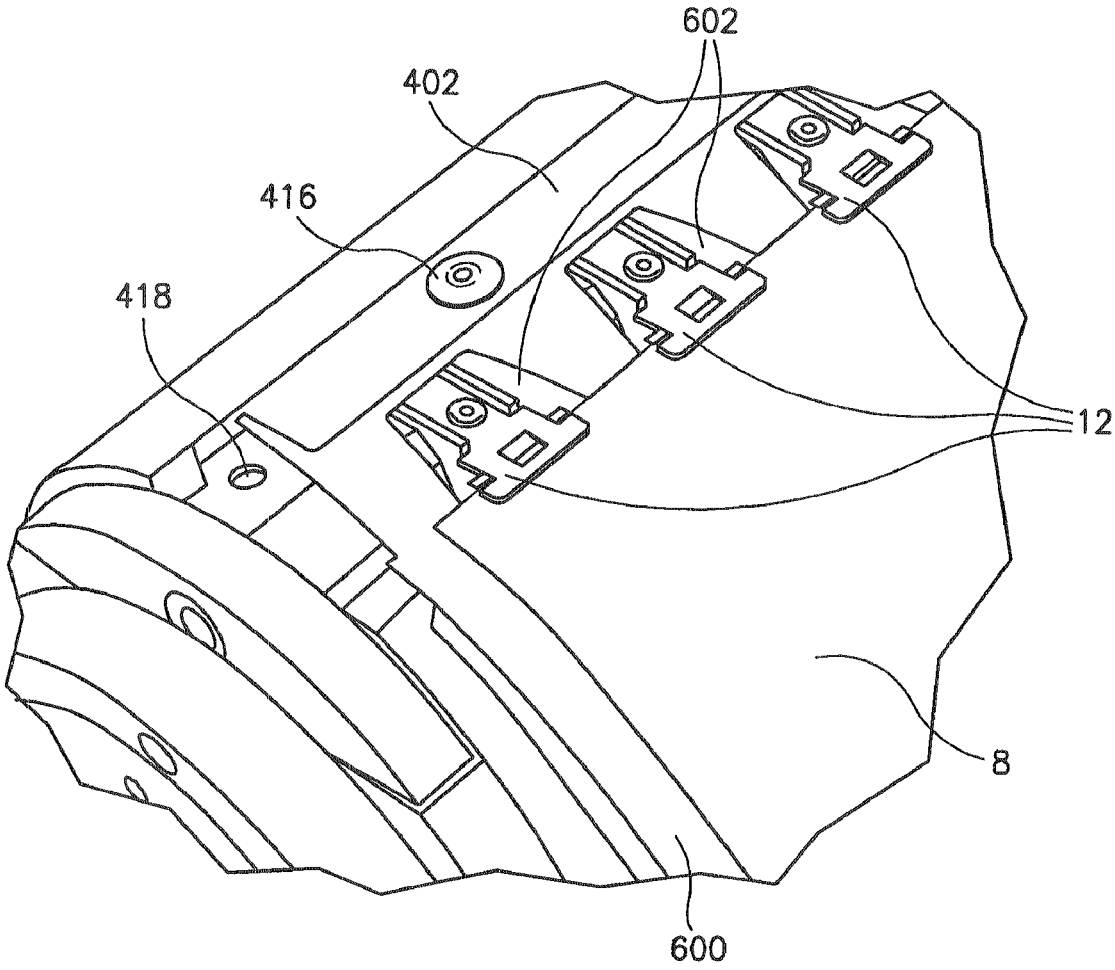
FIG. 7 is the same view as FIG. 6, but also showing printing paper held by the printing paper clamp.

Impression paper clamp 400 comprises an upper portion 402, in the form of a straight bar, and a lower portion. Optionally, upper portion 402 clamps the impression paper directly against in integral part of the impression member, instead of against the lower portion, and in that case there is no need for a lower portion. The lower portion optionally includes a back section 406, which fits into a slot in the impression member, and a number of teeth 408, which press against upper portion 402 to hold the impression paper. The spaces between the teeth optionally allow the grippers to open through corresponding apertures in the impression paper, as shown in FIGS. 6 and 7, to hold the printing media. The number of teeth and grippers is different for some embodiments of the invention than the number of teeth and grippers shown in the drawings, but generally there is still one space between the teeth for each gripper. The middle tooth optionally has a clearance hole 410, for coupler 202. Similarly, back section 406 optionally has a clearance slot 412 for coupler 202.

Two captive nut and bolt assemblies 414 can be tightened, through openings 416 (not visible in FIG. 4 since they are on the hidden top surface of upper portion 402, but visible in FIGS. 5A and 5B), to bring upper portion 402 tightly against the lower portion, to hold the impression paper in place. The nuts and bolts need not be captive, but making them captive prevents them from being lost if they come loose, and prevents them from falling into the interior of the impression member and possibly causing damage or malfunction. Optionally, the upper and lower portions of impression paper clamp 400 are held against each other by another mechanism, such as a spring or clip, and in some embodiments there is no mechanism for tightening impression paper clamp 400. Two attachment tabs 418, with holes in them, optionally allow impression paper clamp 400 to be bolted down when it is installed in the impression member.

Figure 5A:
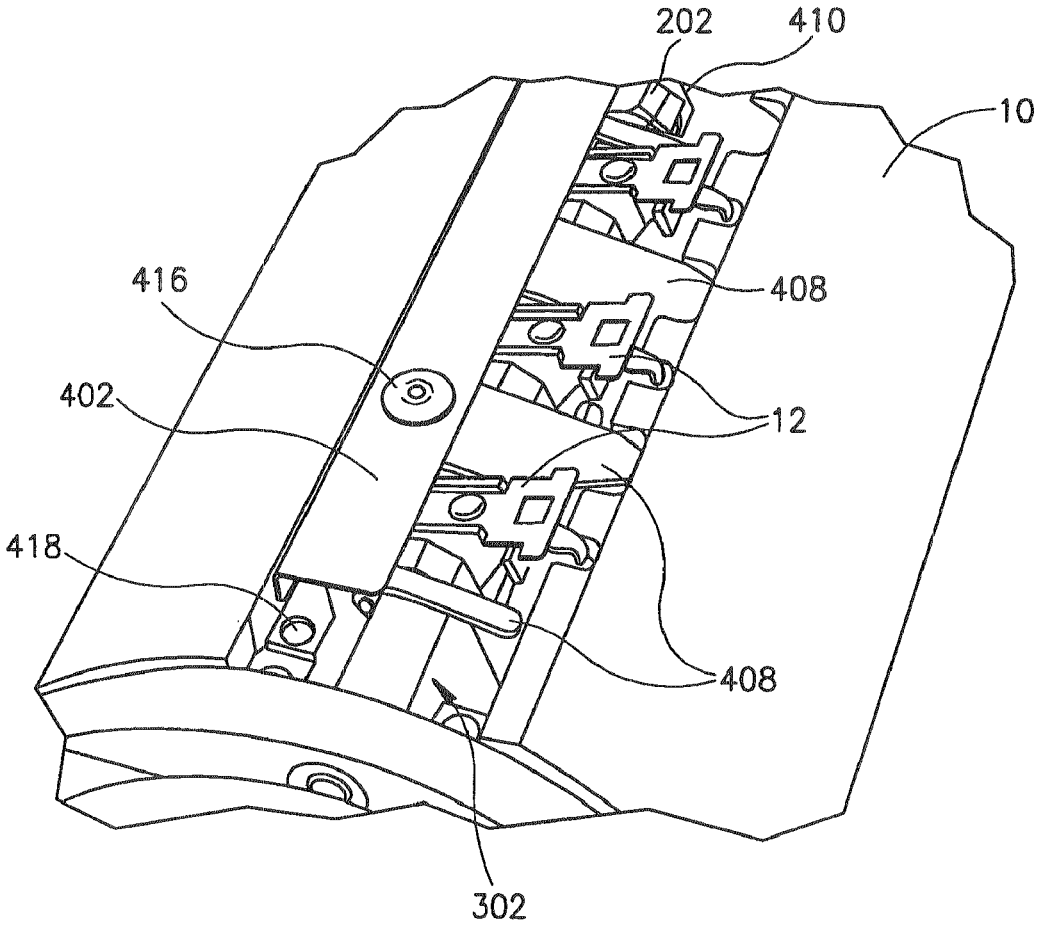
FIG. 5A is a perspective view of part of an impression member with the impression paper clamp installed, but without impression paper installed, according to the same embodiment of the invention, showing the printing paper clamps in a raised position.
Figure 5B:
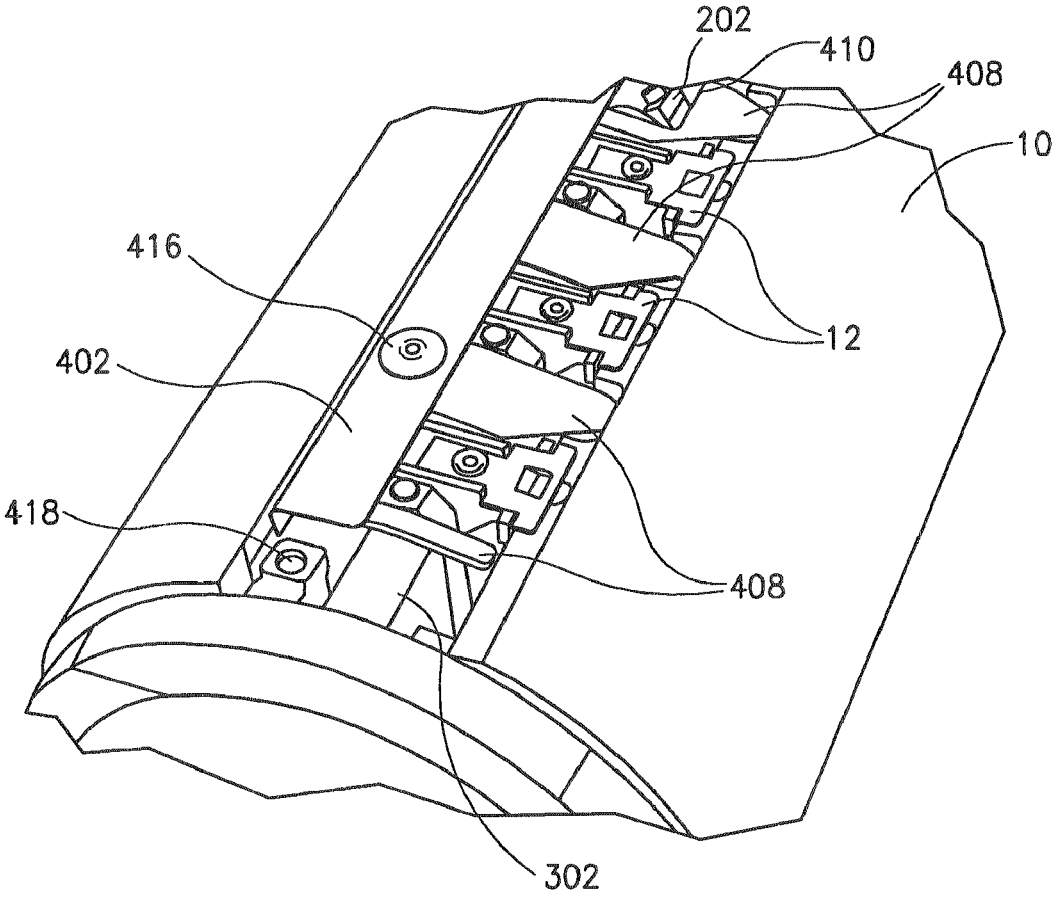
FIG. 5B is the same view as FIG. 5A, showing the printing paper clamps in a lowered position.

FIGS. 5A and 5B show impression paper clamp 400 installed in impression member 10. FIG. 5A shows the grippers in a raised position, and FIG. 5B shows the grippers in a lowered position. Upper portion 402, one of the openings 416, one attachment tab 418, and four of the teeth 408 are visible, as well as printing paper clamps 12. Note that grippers 12 optionally fit into the spaces between teeth 408.

FIG. 6 shows impression paper 600 held at one end by impression paper clamp 400. Trapezoidal apertures 602 in impression paper 600 optionally allow grippers 12 to go through impression paper 600, and to hold the printing media in place. Apertures 602 need not be trapezoidal, but are trapezoidal in this embodiment of the invention to match the shape of grippers in this design of the impression member. Circular hole 604, near the top margin of FIG. 6, optionally allows clearance for coupler 202 to move when the grippers are raised and lowered. Hole 604 is optionally absent in some embodiments of the invention, for example if a mechanism other than coupler 202 is used to connect rods 304 or is no coupler is used or if coupler 202 does not need the clearance.

In FIG. 7, a sheet of printing media 8 is shown held in place by grippers 12, on top of impression paper 600.

Figure 8A:
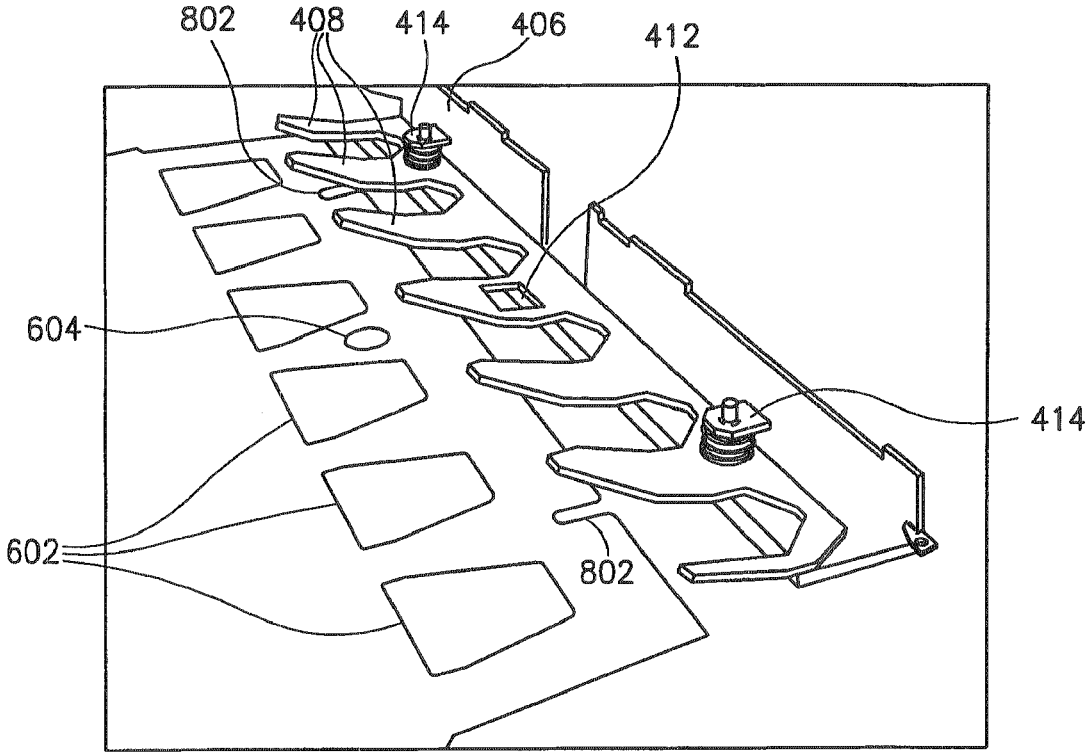
FIG. 8A is a perspective view of the impression paper clamp seen from the bottom, showing one end of the impression paper properly aligned with the impression paper clamp, according to the same embodiment of the invention, but not inserted into the impression paper clamp.

FIG. 8A shows a bottom view of impression paper clamp 400, not installed in the impression member, with impression paper 600 adjacent to it. Impression paper 600 is shown aligned with impression paper clamp 400, as it would be before being inserted. Note that each of the holes 602 corresponds to one of the spaces between teeth 408. Two slots 802 in impression paper 600, which are lined up with nut and bolt assemblies 414. Optionally, a different number of nut and bolt assemblies are used in the impression clamp, and optionally one slot 802 is formed in the impression paper, for each nut and bolt assembly.

When impression paper 600 is inserted into impression paper clamp 400, the bolts in the two assemblies 414 each go through its associated slot 802. Optionally, impression paper 600 lacks slots 802, and is inserted into impression paper clamp 400 only far enough so that its leading edge touches the bolts. However, allowing the bolts to go through slots 802 makes it possible to push impression paper 600 further into impression paper clamp 400, so that it can be held more firmly.

Optionally, slots 802 are replaced by bolt holes for the bolts to go through, and the bolts are disengaged from the nuts and raised above the impression paper until the impression paper is fully inserted, at which time the bolts are lowered through the bolt holes and engaged in the nuts. By using slots 802 instead of holes, the bolts can be kept engaged in the nuts while impression paper 600 is being inserted into impression paper clamp 400. Optionally, in embodiments of the invention where a mechanism other than the nut and bolt assemblies is used to tighten the impression paper clamp, or where there is no mechanism to tighten the impression paper clamp, impression paper 600 does not have slots 802, or bolt holes.

Figure 8B:
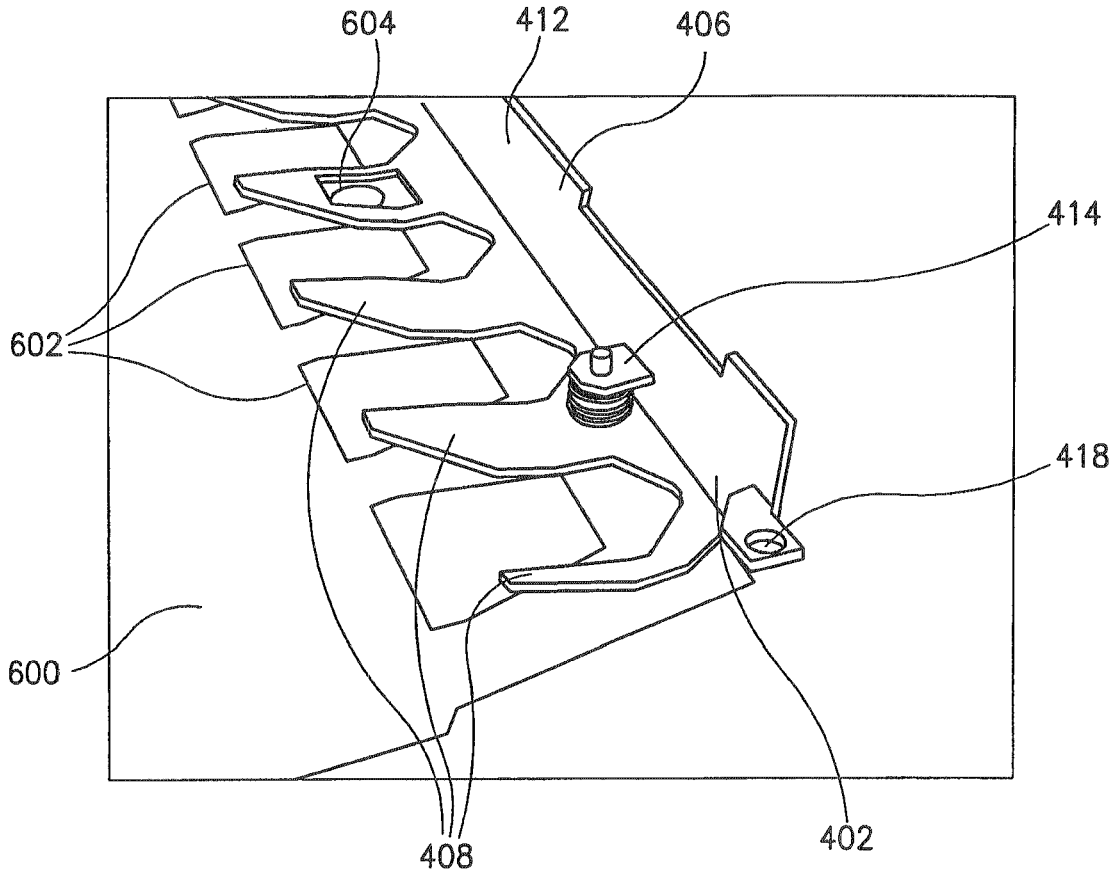
FIG. 8B is the same view as FIG. 8A, showing the end of the impression paper inserted into the impression paper clamp.

FIG. 8B shows impression paper 600 fully inserted into impression paper clamp 400, which is seen from below as in FIG. 8A. Note that trapezoidal apertures 602 are now aligned with the spaces between teeth 408, and circular hole 604 is aligned with hole 410 in the middle tooth. Slots 802 are no longer visible, as they are hidden by the lower portion of the impression paper clamp.

Although FIGS. 8A and 8B show the paper brought adjacent to the impression paper clamp, and then inserted into the impression paper clamp, when the impression paper clamp is not mounted on the impression member, in actual operation, the impression paper is inserted into the impression paper clamp when the impression paper clamp is already mounted on the impression member. The two views of the dismounted mechanism are used to better illustrate the method of mounting the impression paper.

Figure 9:
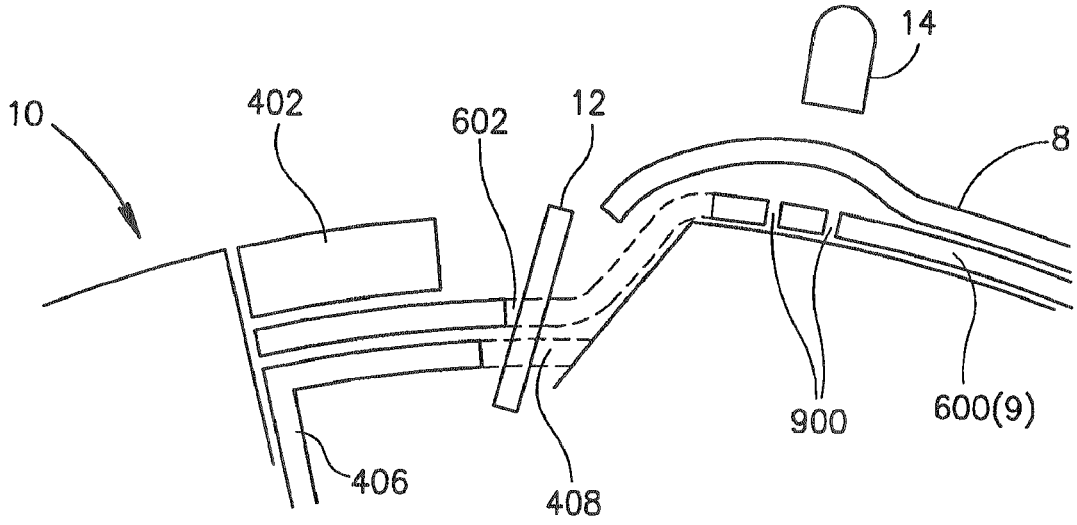
FIG. 9 is a schematic cross-sectional view of the impression paper, impression member, and suction cup, according to an exemplary embodiment of the invention.

FIG. 9 shows a schematic cross-sectional view of impression member 10, impression paper 600, printing media 8, and suction cup 14. Gripper 12 is in a raised position, so that suction cup 14 can pull printing media 8 off impression member 10. Impression paper 600 is held in place by impression paper clamp 400. Dashed lines show trapezoidal hole 602 in impression paper 600. Suction cup may pull the printing media from the impression roller at a distance, as shown or may come into contact with the printing media while it is still flat on the impression media.

Impression paper 600 is formed with apertures, such as narrow slits 900 or a pattern of small holes, beneath suction cup 14. When suction cup 14 pulls printing media 8 away from impression paper 600, a partial vacuum would be created between the smooth surfaces of printing media 8 and impression paper 600. Slits 900 allow air from the space between impression paper 600 and impression member 10 to flow into the space between impression paper 600 and printing media 8, preventing a significant vacuum from forming, and allowing suction cup 14 to pull printing media 8 away from impression paper 600 and impression member 10 in a controlled, predictable manner. It should be noted that because grippers 12 are no longer holding printing media 8 and impression paper 600 down against impression member 10, and because the other end of impression paper 600 opposite the end held by impression paper clamp 400) is free, and because impression paper 600 is somewhat stiff, impression paper 600 may not lie flat against impression member 10, so there may be a space filled with air between impression member 600 and impression member 10, which can flow through slits 900. In other embodiments of the invention, not all these conditions are met, however, even if only some of the conditions are met, there may still be enough air flowing through slits 900 so that suction cups 14 pull media 8 off impression member 10 in a controlled manner. However, as indicated above, while single slits or single or multiple apertures can be used for releasing the vacuum formed, they have a tendency to become clogged with debris, such as paper fibers. Thus, for this embodiment, the size of the apertures must be increased, for example greater than 0.1 mm and preferably larger, up to a size which interferes with the printing quality, which may be some larger fraction of a mm.

In a preferred embodiment of this aspect of the invention, the apertures are slits that are formed in pairs. Under these circumstances, the effect of lifting of the printing media is to lift the region between the slits. This allows air to enter the region between the printing media and the impression paper, releasing the vacuum. For this embodiment, the width of the slits is not a factor in the operational life of the impression paper and the slits are preferably made as thin as possible, for example 0.1 mm or less (e.g., 0.05 or 0.02 mm). However, the invention is not limited to such thin slits, which may be difficult to manufacture.

In general, it is desirable that the distance between slits be smaller than the size of suction cup 14. At present a distance of about 7 mm is used. However, smaller distances can be used and more than two slits may be provided beneath each suction cup. Furthermore, the length of the slits should be at least as long as the diameter of the suction cups, to aid in the lifting of the portion between the slits. However, this is not absolutely necessary.

The one suction cup 14 shown in FIG. 9 optionally represents two or more suction cups arranged in a direction perpendicular to the plane of FIG. 9. Optionally, there are one or more slits 900 in the impression paper beneath each suction cup. In the system where the impression paper slits have been tested by the inventors, for example, there are four suction cups, and there are two slits beneath each suction cup, or a total of eight slits in the impression paper.

Slits 900 need not be used in conjunction with impression paper clamp 400, but optionally could be used in impression paper that is attached to the impression member in a different way, for example by gluing.

Figure 10:
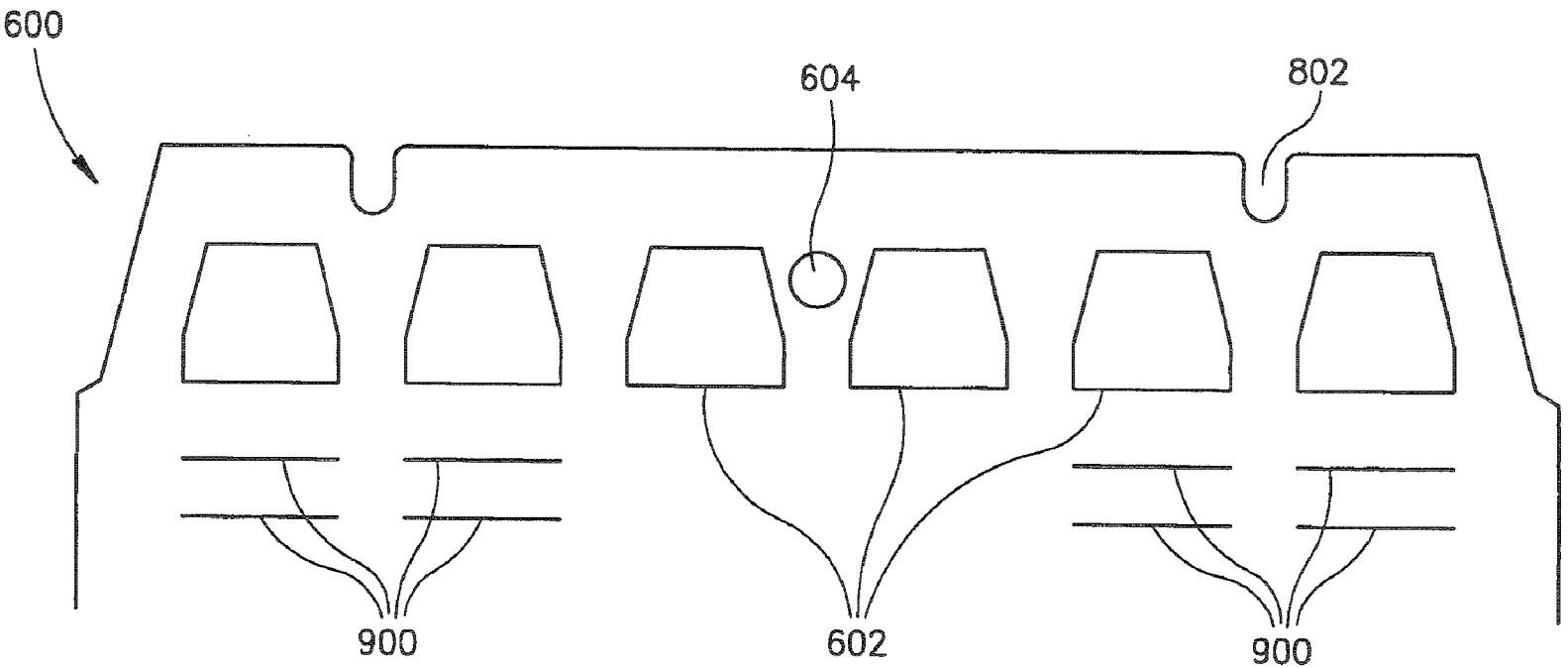
FIG. 10 shows the layout of part of the impression paper, according to an exemplary embodiment of the invention.

FIG. 10 shows an outline of one end of a piece of impression paper 600, the end that is held by the impression paper clamp, according to an embodiment of the invention that is being tested. Six trapezoidal apertures 602, circular hole 604, two slots 802, and eight slits 900 are visible. The width of slits 900 is exaggerated so that they are visible. In fact, the slits are only 0.1 mm wide, in this embodiment of the invention. As noted previously, the number, size and shape of any of these features may be different, and any of these features may not exist, in some embodiments of the invention, depending, among other factors, on the design of the impression member and the impression paper clamp.

Impression paper preferably has a number of desired characteristics. First, the impression paper should be strong enough so that it can stand the sliding forces induced on it, considering that it contains a series of cut-outs. Second, it is desirable that the impression paper be smooth and of uniform thickness. This avoids texturing of the images printed on the printing media. Third, it should absorb the ink from the intermediate transfer member, in case of a paper miss-feed. However, since the same impression roller may also be used for printing a second side of duplex, it should not offset ink from the first side, when an image is transferred to the second side from the (hot) intermediate transfer member. Fourth, while it is desirable that the impression paper be stiff, it is also desirable that the paper conform to the curvature of the impression member. Of course, in order to work, impression paper need not be optimized for all or even any of these parameters.

It has been found that Gardamatt Art paper (Garda Cartiere, Italy) provides a suitable impression paper, for various thicknesses from nominally 101 micrometers thickness (Gardamatt 115) to nominally 313 micrometers thickness (Gardamatt 300), although thicker paper (>200 micrometers) are sturdier. The smoothness of this paper veries between 20.+–0.5 to 30 or 40.+–0.10 or 20 for the thinner papers. However, the smoothness is not critical, so long as there is no texturing of the image. This paper is short fiber paper and is cut so that the stiffer direction is parallel to the axis of the impression roller. This allows the impression paper to conform to the impression roller.

The invention has been described in the context of the best mode for carrying it out. It should be understood that not all features shown in the drawings or described in the associated text may be present in an actual device, in accordance with some embodiments of the invention. Furthermore, variations on the method and apparatus shown are included within the scope of the invention, which is limited only by the claims. Also, features of one embodiment may be provided in conjunction with features of a different embodiment of the invention. Furthermore, it should be understood that not all of the embodiments of the invention solve all of the problems that are associated with the prior. It is contemplated that some problems of the prior art will be solved by other means or will not be solved at all. As used herein, the terms "have", "include" and "comprise" or their conjugates mean "including but not limited to."

What is claimed is:

1. A mechanism for transferring an image to a printing media comprising:

an impression member having an impression surface;

impression media comprising a flexible sheet covering a portion of the impression surface, the flexible sheet formed with at least one first aperture located entirely beneath the printing media when held on the impression surface; and a printing media holding mechanism operative to controllably hold the printing media on the impression surface on top of the impression media and to controllably release the printing media, wherein the impression media comprises a sheet having a first end and a second end opposite the first end, the impression media being supported about a circumference of the impression member, the sheet having second apertures through which the printing media holding mechanism extends, each of the second apertures having a first circumferential side spaced from the first end and a second circumferential side opposite the first circumferential side, the second circumferential side extending between the first circumferential side and the second end while being spaced from the first end and the second end, wherein each of the first apertures is surrounded on all sides by the sheet and wherein the mechanism further comprises:

an impression media holding mechanism contacting the sheet circumferentially between the first circumferential side of each of the second apertures and the first end of the sheet.

2. The mechanism of claim 1 further comprising a removal mechanism configured to remove the printing media from the impression media.

3. The mechanism of claim 2, wherein the removal mechanism comprises vacuum elements that remove the printing media from the impression media.

4. The mechanism of claim 3, wherein the at least one first aperture is situated beneath a position at which the vacuum elements come into proximity or contact with the printing media on the impression media to at least reduce a partial vacuum between the impression media and the printing media thereat.

5. The mechanism of claim 1, wherein the printing media holding mechanism comprises printing media grippers operative to hold an edge of the printing media on the impression member.

6. The mechanism of claim 5, wherein the second apertures correspond to the printing media grippers, wherein the impression media continuously extends completely about the grippers and wherein the grippers open and close through the second apertures.

7. The mechanism of claim 5, wherein the second apertures correspond to the printing media grippers; and wherein the mechanism further comprises:

an impression media holding mechanism, wherein the flexible sheet is supported on a circumference of the impression member, wherein a majority of the sheet lies on a first circumferential of side of the at least one aperture and wherein the impression media holding mechanism contacts the sheet on a second circumferential side of the at least one aperture opposite the first side.

8. The mechanism of claim 7, wherein the impression media holding mechanism comprises one or more of at least one clamp that contacts opposite faces of the impression media; at least one impression media grippers and an adhesive.

9. The mechanism of claim 1, wherein the at least one first aperture extends completely through the flexible sheet from a first face of the sheet to a second opposite face of the sheet.

10. The mechanism of claim 9, wherein the at least one first aperture comprises an elongate slit extending completely through the flexible sheet.

11. A mechanism for transferring an image from a first surface to printing media, the mechanism comprising:

an impression member having an impression surface, wherein the impression surface is a surface of an impression roller and wherein the impression surface and the first surface move together in a same direction at a region of proximity or contact between them;

printing media grippers associated with the impression surface adapted for holding an edge of the printing media on the impression member during transfer and then controllably releasing the print media after transfer;

impression media held on the impression surface such that the impression media extends past the edge of the printing media held by the printing media grippers, wherein the impression media is held on the impression roller by at least one impression media holding mechanism and wherein the holding mechanism comprises one or more of at least one clamp that contacts opposite faces of the impression media; at least one impression media gripper; and an adhesive; and first apertures corresponding to the printing media grippers, wherein the impression media continuously extends completely about the grippers and wherein the grippers open and close through the first apertures.

12. The mechanism of claim 11, further comprising vacuum elements that remove the printing media from the impression media.

13. The mechanism of claim 12, further comprising at least one aperture situated beneath a position at which the vacuum elements come into proximity or contact with the printing media on the impression media to the least reduce a partial vacuum between the impression media and the printing media thereat.

14. The mechanism of claim 11 further comprising second apertures located entirely beneath the printing media when held on the impression surface.

15. A mechanism comprising:

an impression member having an impression surface;

printing media grippers associated with the impression surface adapted for holding an edge of printing media on the impression member during transfer of an image from a first surface to the printing media and then controllably releasing the printing media after transfer;

impression media held on the impression surface such that the impression media extends past the edge of the printing media held by the printing media grippers, wherein the impression media comprises a sheet having a first circumferential end and a second circumferential end opposite the first end, the impression media being supported about a circumference of the impression member, the sheet having first apertures through which the printing media grippers extend, each of the first apertures having a first circumferential side spaced from the first end and a second circumferential side opposite the first circumferential side, the second circumferential side extending between the first circumferential side and the second end while being spaced from the first end and the second end, wherein each of the first apertures is surrounded on all sides by the sheet; and an impression media holding mechanism contacting the sheet circumferentially between the first circumferential side of each of the first apertures and the first end of the sheet.

16. The mechanism of claim 15 further comprising second apertures located entirely beneath the printing media when held on the impression surface.

17. The mechanism of claim 15 further comprising a removal mechanism comprising vacuum elements that remove the printing media from the impression media.

18. The mechanism of claim 17, wherein the at least one aperture is situated beneath a position at which the vacuum elements come into proximity or contact with the printing media on the impression media to the least reduce a partial vacuum between the impression media and the printing media thereat.

19. A mechanism for transferring an image to a printing media comprising:

an impression member having an impression surface;

impression media comprising a flexible sheet covering a portion of the impression surface, the flexible sheet formed with at least one first aperture located entirely beneath the printing media when held on the impression surface;

a printing media holding mechanism operative to controllably hold the printing media on the impression surface on top of the impression media and to controllably release the printing media, wherein the at least one first aperture extends completely through the flexible sheet from a first face of the sheet to a second opposite face of the sheet and wherein the at least one first aperture comprises an elongate slit extending completely through the flexible sheet;

printing media gibbers associated with the impression surface adapted for holding an edge of the printing media on the impression member during transfer and then controllably releasing the print media after transfer; and second apertures through the impression media and corresponding to the printing media grippers, wherein the impression media continuously extends completely about the grippers and wherein the grippers open and close through the second apertures.

* * * * *

UNITED STATES PATENT AND TRADEMARK OFFICE

CERTIFICATE OF CORRECTION

PATENT NO. : 8,397,635 B2
APPLICATION NO. : 12/582331
DATED : March 19, 2013
INVENTOR(S) : Alex Feygelman et al.

It is certified that error appears in the above-identified patent and that said Letters Patent is hereby corrected as shown below:

In the Claims:

In column 8, line 5, in Claim 7, delete “grippers;” and insert -- grippers --, therefor.

In column 10, line 19, in Claim 19, delete “gibbers” and insert -- grippers --, therefor.

Signed and Sealed this
Thirteenth Day of August, 2013

Teresa Stanek Rea
*Acting Director of the United States Patent and Trademark Office*